United States Patent [19]

Issakainen

[11] Patent Number: 4,514,111

[45] Date of Patent: Apr. 30, 1985

[54] METHOD OF AND APPARATUS FOR INSTALLING SOLDER BOLTS IN ROCK BOLTING

[75] Inventor: Onni Issakainen, Tampere, Finland

[73] Assignee: Oy Tampella AB, Tampere, Finland

[21] Appl. No.: 426,004

[22] Filed: Sep. 28, 1982

[30] Foreign Application Priority Data

Jun. 4, 1982 [FI] Finland ..... 822004

[51] Int. Cl.[3] ..... E21D 20/02

[52] U.S. Cl. ..... 405/260; 405/303

[58] Field of Search ..... 405/259, 260, 261, 262, 405/303; 173/39; 227/77, 85

[56] References Cited

U.S. PATENT DOCUMENTS

| | | | |
|---|---|---|---|
| 3,222,873 | 12/1965 | Williams | 405/260 |
| 3,301,123 | 1/1967 | Worley | 405/259 X |
| 3,942,329 | 3/1976 | Babcock | 405/260 |
| 4,079,592 | 3/1978 | Eakin | 405/260 |
| 4,085,492 | 4/1978 | Stange | 405/259 X |
| 4,201,270 | 5/1980 | Ribich et al. | 405/259 X |
| 4,226,559 | 10/1980 | Prebensen | 405/303 |

*Primary Examiner*—David H. Corbin
*Attorney, Agent, or Firm*—Ladas & Parry

[57] ABSTRACT

A method of installing solder bolts in rock bolting, according to which method a bolt (11) is fed into a hole (12) drilled in the rock and is anchored in the hole during hardening of a soldering material (13). The bolt is bent during feeding into the hole in order to produce in the bolt at least one such bend (11*a*) that the bolt, when entirely inserted in the hole, is wedged in between opposite walls of the hole. A bolt feeding apparatus for carrying out the method includes a feed beam (8), a feeding device (9) supported by said beam for feeding a rock bolt into a drill hole, a displacing device for displacing the feeding device along the feed beam, and a rock support (6) for supporting the feed beam on the rock. The apparatus is provided with guiding means which, as the feeding device is moved along the feed beam, displace the feeding device away from a bolt feeding position coaxial with the axis of the drill hole and return the feeding device back to said feeding position.

8 Claims, 8 Drawing Figures

METHOD OF AND APPARATUS FOR INSTALLING SOLDER BOLTS IN ROCK BOLTING

Figure 3:
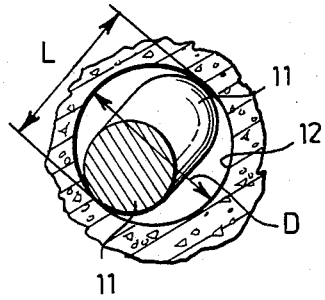

The present invention relates to a method of installing solder bolts in rock bolting, according to which method a bolt is fed into a hole drilled in the rock and is anchored in the hole during hardening of a soldering material.

In rock bolting, bolts are by means of a soldering material, such as concrete or resin, anchored in holes drilled in the rock for reinforcing the rock in mines and excavations.

A problem encountered in rock bolting is how to retain the bolt in the hole until the soldering material has hardened. To this end, different methods and specially constructed bolts have been used.

The most common method is to wedge the bolt, e.g. by means of wooden wedges at its outer end into the hole, which has required manual labour.

In mechanical bolting, various anchoring bolts and specially designed bolts have been used which due to their design are retained in place in the hole. The use of specially designed bolts has caused difficulties in mechanized bolting because the bolts have been poorly retained in the bolt cassette and the guiding of the bolts into the hole has been difficult.

The object of the present invention is to provide a method which eliminates the above-mentioned disadvantages and permits the use of ordinary straight bolts in rock bolting. This object is achieved by means of the method according to the invention which is characterized in that the bolt is bent during feeding into the hole to produce at least one such bend in the bolt that the bolt, when entirely inserted in the hole, is wedged in between opposite walls of the hole.

The invention is based on the idea of bending a straight bolt into a bend after the bolt has been inserted in the hole but before the bolt has been fed to its final depth in the hole. Owing to this bending, the bolt is "expanded" in the transverse direction to such an extent that the bolt, when entirely inserted in the hole, is firmly pressed against the wall of the hole and is retained in place by means of friction without any other anchoring elements or auxiliary means. The method has the advantage of enabling the use of straight bolts whereby the handling of such bolts in bolt cassettes is secure and easy. No expensive and complicated anchoring elements are required in the bolts, due to which the bolts are less expensive. The bolt is guided into the hole in a reliable manner. No complicated special constructions are required but the method is applicable to apparatuses already in use.

The bending of the bolt can be carried out either during a continuous feeding of the bolt or by interrupting the feeding during the bending step.

The bending is preferably carried out when about one half or more of the length of the bolt has been fed into the hole, at which stage the tip end of the bolt does not press firmly against the wall of the hole and, consequently, does not hamper the feeding of the bolt. If necessary, bolts with rounded tip ends may be used.

The invention also relates to a bolt feeding apparatus for carrying out the above described method and this apparatus is characterized in that the apparatus is provided with guiding means which, as the feeding device moves along the feed beam, displace the feeding device from the axis of the drill hole and return the feeding device back to said axis.

The method according to the invention is applicable by means of a conventional bolt feeding apparatus which only has to be provided with simple guiding means by means of which the feeding device or the feed beam can be momentarily deflected from the normal path of movement in which the axis of the bolt coincides with the axis of the drill hole, in order to obtain a bend in the bolt.

Alternatively, it is possible to carry out the method by means of an apparatus which is characterized in that the feed beam is provided with a bending device which is displaceable to the path of movement of the bolt in order to bend the bolt at a position between the feeding device an the drill hole.

In such an apparatus, the feeding device or the feed beam need not at all be displaced while feeding the bolt because the bending of the bolt is carried out by means of a separate bending device.

Figure 2:
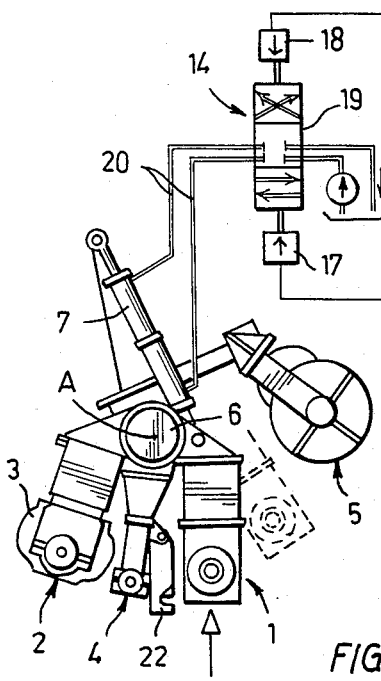
Figure 4:
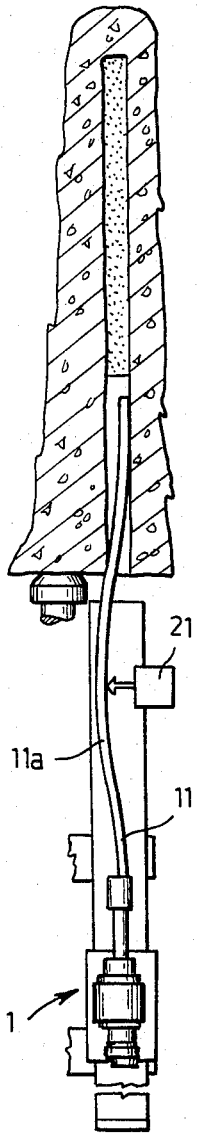

The invention will be described in more detail in the following with reference to the accompanying drawings, wherein FIGS. 1A to 1E illustrate a bolt feeding apparatus in five different feeding positions which illustrate separate operational steps of the method according to the invention, FIG. 2 is an end view of a bolting head provided with a bolt feeding apparatus and illustrates the guiding means according to the invention, FIG. 3 is a cross-sectional view illustrating the principle of anchoring a bolt according to the invention, and FIG. 4 is a schematic view of an alternative bolt feeding apparatus.

The bolt feeding apparatus shown in the FIGS. 1A to 1E of the drawings forms a part of the bolting head shown in FIG. 2. Said bolting head further comprise a drilling apparatus 2 including a drilling machine 3, a feeding apparatus 4 for soldering material, a bolt cassette 5, a rock support 6, displacing arms 22 and a pressure medium cylinder 7 for pivoting the parts 1, 2 and 4 around an axis A of the rock support. The bolting head is by means of brackets (not shown) supported on a suitable transfer frame or vehicle.

The bolt feeding apparatus 1 includes a feed beam 8 supporting a feeding device 9 which is displaceable along the feed beam by means of a displacing means 10. Rock bolts 11 are one at a time displaced in parallel with the feed beam by means of displacing arms 22 from the bolt cassette to the axis of the feeding device 9. Each bolt is during operation of the bolt feeding apparatus guided at one of its ends into a cup-shaped bolt holder of the feeding device 9 and at its other end into a drill hole 12.

Figure 1A:
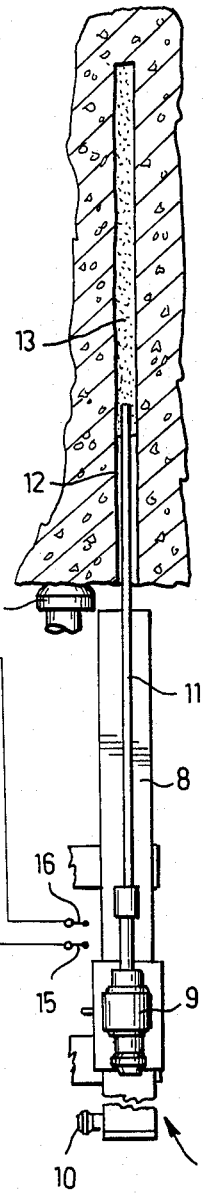

FIG. 1A illustrate a stage where the bolt feeding apparatus 1 is supported against the rock by means of the rock support 6 and the apparatus has by means of the cylinder 7 been pivoted to such a position that the axes of the feeding device and the bolt are aligned with the axis of the hole 12 drilled in the rock. The feeding device has started to feed the bolt into the hole.

Figure 1B:
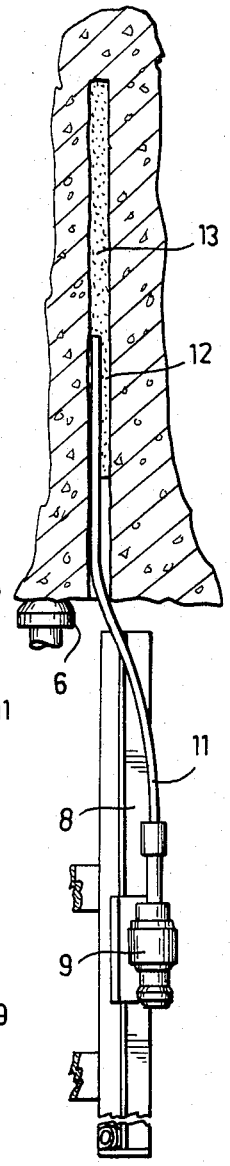

FIG. 1B illustrates a stage where about one half of the bolt has been fed into the hole and the bolt feeding apparatus 1 has by means of the cylinder 7 been pivoted to a position where the axis of the feeding device is displaced from the axis of the hole. Due to this, the bolt will be bent. The pivoting movement is so extensive that the bending of the bolt causes a permanent deformation in the bolt.

Figure 1C:
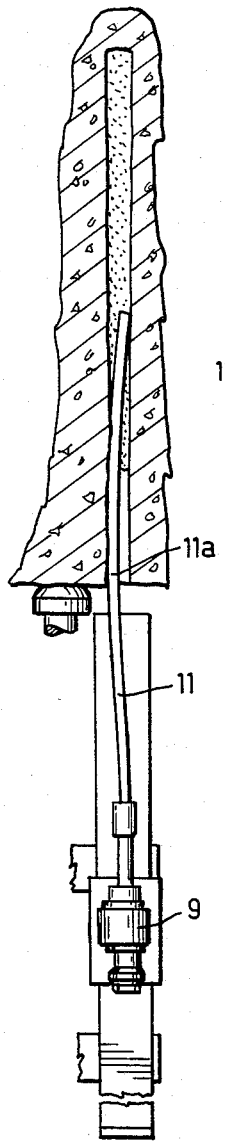

FIG. 1C illustrates a stage where the bolt feeding apparatus 1 has by means of the cylinder 7 been pivoted back to the position shown in FIG. 1A. Due to the pivoting movement according to FIG. 1B, a permanent bend 11*a* remains in the bolt.

Figure 1D:
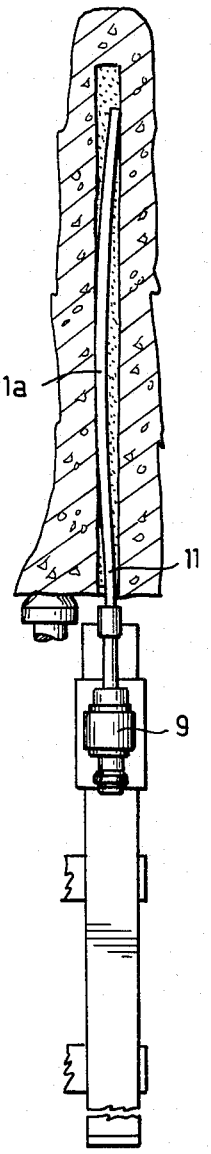

FIG. 1D illustrates a stage where the feeding device has fed the entire length of the bolt into the hole.

Figure 1E:
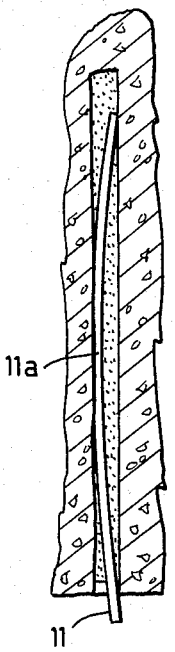

FIG. 1E illustrates a stage where the feeding device has been detached from the bolt and has been removed. Due to the bend 11*a* in the bolt, the bolt presses with its both ends and with the central part against opposite walls of the hole. In order to cause the bolt to press firmly enough against the walls of the hole so as to remain in the hole by means of friction, the bolt must be bent at least so much that the permanent bend produced in the bolt widens the axial projection of the bolt to such an extent that the greatest width L of the bolt, FIG. 3, is so much bigger than the diameter D of the drill hole that a sufficient frictional force is in each case produced to keep the bolt in place in the hole. Reference numeral 13 indicates soldering material fed in advance into the drill hole.

According to FIGS. 1B and 1C, the feeding of the bolt has been interrupted while the bolt is being bent. The bolt can also be fed continuously forwards during bending.

The pivoting of the apparatus at the bending step of the bolt can be automatically obtained by means of the guiding device shown in FIGS. 1A and 2. Two sensor elements 15, 16 are fastened to the feed beam 8 on the path of movement of the feeding device 9 at a distance from each other. Said sensor elements are connected to actuating elements 17, 18 which actuate a valve 19 which is connected in a pressure medium circuit 20 for the cylinder 7.

When the feeding device reaches the sensor element 15, it sends an impulse to the actuating element 17 which momentarily actuates the valve 19 (upwards in FIG. 2). Due to this, the pivoting cylinder 7 pivots the feed beam from the position shown in full lines in FIG. 2 to the position shown in dotted lines which corresponds to the bending position shown in FIG. 1B. When the feeding device reaches the other sensor element 16, it sends an impulse to the actuating element 18 which momentarily actuates the valve 19 (downwards in FIG. 2). Due to this, the pivoting cylinder pivots the feed beam back to the position shown in full lines in FIG. 2.

If the feeding of the bolt has been interrupted during the bending of the bolt, the actuating element 18 may be connected, for example, to a timer so that the actuating element 18 operates a certain time after the operation of the actuating element 17.

The guiding impulses for the valve 19 can also be obtained from the number of revolutions of the displacement motor of the feeding device, from the time spent for feeding of the bolt, or the like. The guiding can also be carried out by means of a timer which pivots the feed beam during a predetermined time and thereafter returns it to its initial position.

FIG. 4 illustrates an alternative bolt feeding apparatus in which a separate bending device 21, such as a hydraulic cylinder, an eccentric mechanism, or the like is fastened to the feed beam.

The drawings and the related description are only intended to illustrate the idea of the invention. In its details, the method and the apparatus according to the invention may vary within the scope of the claims.

What I claim is:

1. A method of installing solder bolts into preformed hole in a rock, comprising the steps of:

(A) preforming of at least one said hole in the rock;

(B) filling of said hole with a soldering material;

(C) inserting of a portion of said bolt into said hole;

(D) producing of at least one bend on a fastening portion of said bolt extending out of said hole, said fastening portion of the bolt being bent to such extent that a width of an axial projection of said bolt becomes bigger than an inside diameter of said hole; and (E) inserting of said bended fastening portion of said bolt into said hole in a such manner that in an inserted condition said bolt is firmly pressed between opposite wall portions of said hole and is retained in a place by a force of friction between said bolt and said wall portions of the hole.

2. A method according to claim 1 wherein the bolt (11) is bent during continuous feeding of the bolt.

3. A method according to claim 1 wherein the bolt (11) is bent during an interruption in the feeding of the bolt.

4. A method according to claim 2 or 3, characterized in that the bolt (11) is bent when at least one half of the length of the bolt has been fed into the hole (12).

5. A bolt feeding apparatus for installing solder bolts in rock bolting comprising a feed beam (8), a feeding device (9) supported by said feed beam for feeding a rock bolt (11) into a drill hole (12), a displacing device (10) for displacing said feeding device along the feed beam, and a rock support for supporting the feed beam against a rock, characterized in that the apparatus is provided with guiding means (14) which after the feeding device (9) has fed the bolt over a predetermined distance displace the feeding device away from a bolt feeding position coaxial with the axis of a drill hole (12) and return said feeding device back to said position.

6. An apparatus according to claim 5, wherein the feed beam (8) is pivotable in relation to said rock support (6) by means of a pivoting cylinder (7), characterized in that said guiding means (14) include an actuating device (17, 18, 19) which actuates said pivoting cylinder to displace the feed beam (8) in relation to the rock support away from the bolt feeding position and to return the feed beam to said feeding position.

7. An apparatus according to claim 6, characterized in that said actuating device (17, 18, 19) actuating the pivoting cylinder (7) is connected to sensor elements (15, 16) actuated by the feeding device to a revolution counter operated by the displacing device (10), to a timer activated by the feeding device, or the like.

8. A bolt feeding apparatus for installing solder bolts in rock bolting comprising a feed beam (8), a feeding device (9) supported by said feed beam for feeding a rock bolt (11) into a drill hole (12), and a displacing device (10) for displacing said feeding device along the feed beam, characterized in that the feed beam (8) is provided with a bending device (21) for bending the bolt at a position between the feeding device and the drill hole (12).

* * * * *